United States Patent [19]

Hsu

[11] 4,200,957

[45] May 6, 1980

[54] SELF-CLOSING DOOR HINGE

[76] Inventor: Yun T. Hsu, 30-27, Chun In Rd. Chun In Village, Tong Sun, Hsiang, I Lan Hsien, Taiwan

[21] Appl. No.: 907,860

[22] Filed: May 19, 1978

[51] Int. Cl.[2] ..... E05F 1/06

[52] U.S. Cl. ..... 16/154

[58] Field of Search ..... 16/153, 154, 152

[56] References Cited

U.S. PATENT DOCUMENTS

| | | | |
|---|---|---|---|
| 933,648 | 9/1909 | Kaufman | 16/153 |
| 1,516,330 | 11/1924 | Butterfield | 16/154 |
| 1,691,759 | 11/1928 | Fischer | 16/153 |
| 1,942,715 | 1/1934 | Kunzelman | 16/153 |
| 3,089,184 | 5/1963 | Kerman | 16/154 X |

FOREIGN PATENT DOCUMENTS

| | | | |
|---|---|---|---|
| 25556 | 9/1906 | Austria | 16/153 |
| 370331 | 12/1906 | France | 16/153 |

*Primary Examiner*—George H. Krizmanich

*Attorney, Agent, or Firm*—Cushman, Darby & Cushman

[57] ABSTRACT

A self-closing door hinge is characterized as that the door can be automatically closed after opening the door and released by hand without any other power aid. Said self-closing door hinge comprises: A main hinge and two auxiliary hinges. Said main hinge is composed of: a right hinge leaf with sleeve, and a left hinge leaf with pivot. Said pivot of left leaf is provided with extended pin rollers which engage with the grooves in said sleeve of the right leaf.

Said grooves are made horizontally from 0 degree through 50 degrees based on the zero degree line as door closing and then inclined upwards from 50° through 180°. Whenever opening the door, the pivot of the left hinge leaf fixed on the door will be rotated so that the pin rollers thereof may be slipped along the grooves so as to raise the left hinge leaf and door upwards against the right hinge leaf which is fixed on the door frame. The raised door having potential will automatically fall by the gravitational force so as to close the door itself.

6 Claims, 16 Drawing Figures

Fig. 1
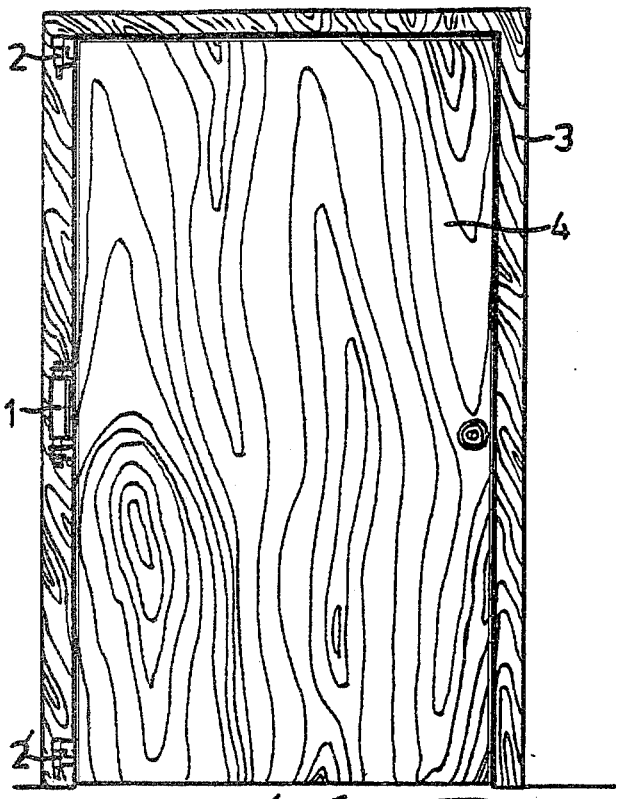
Fig. 2
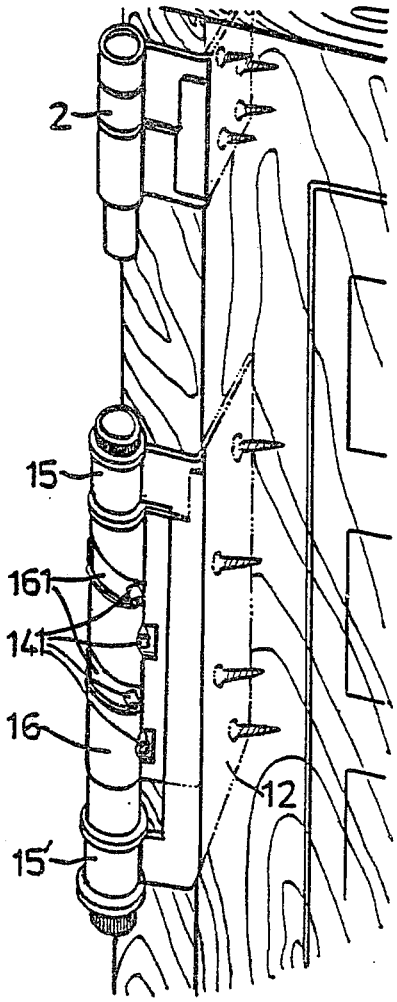
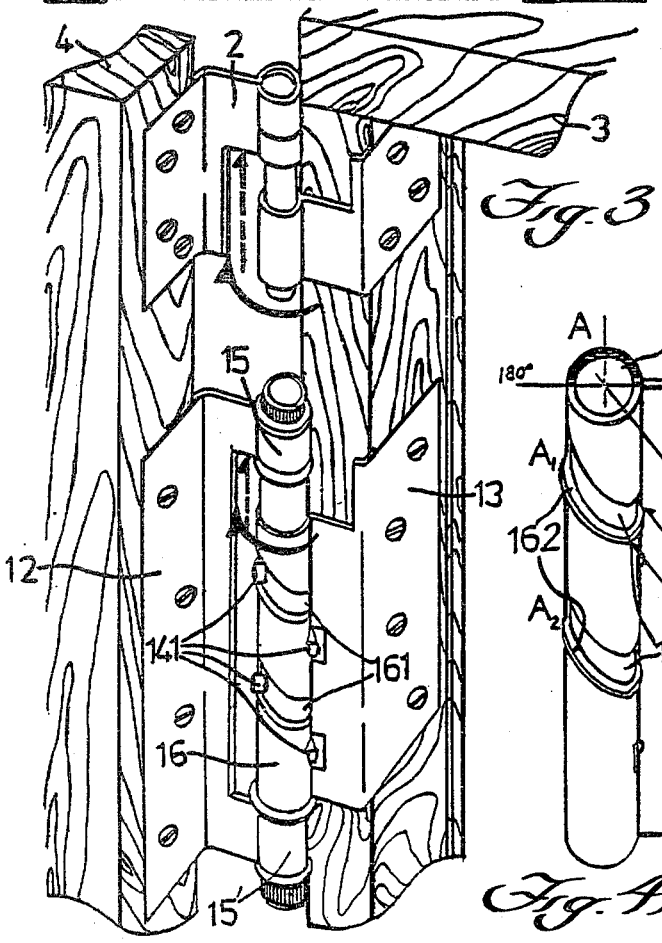
Fig. 3
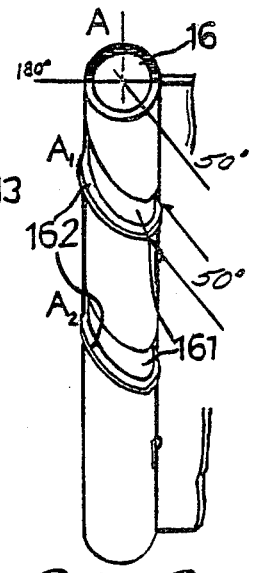
Fig. 4A
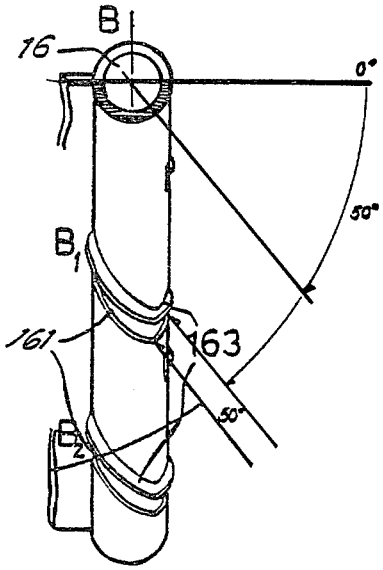
Fig. 4B

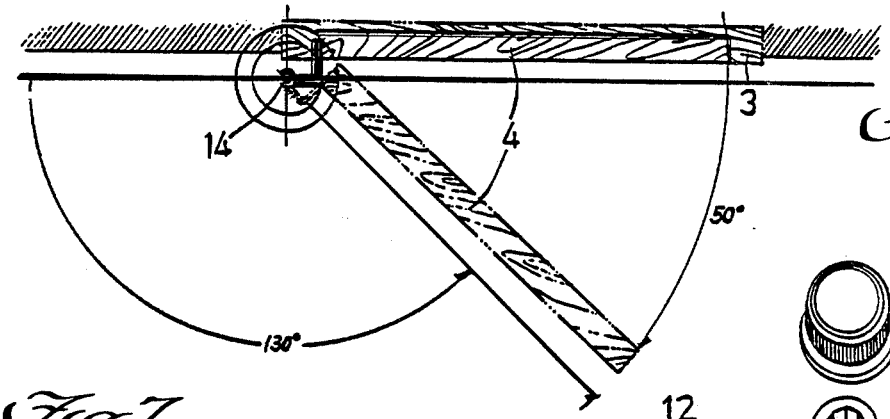
Fig. 5
Fig. 7
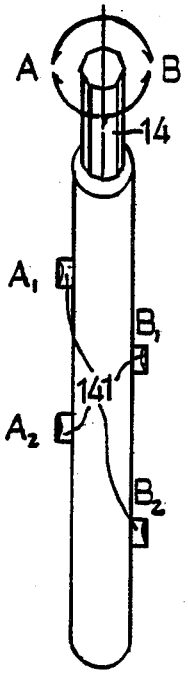
Fig. 9A
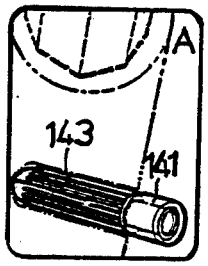
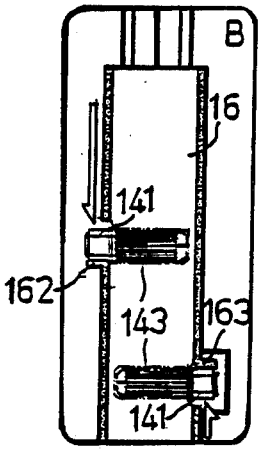
Fig. 9B
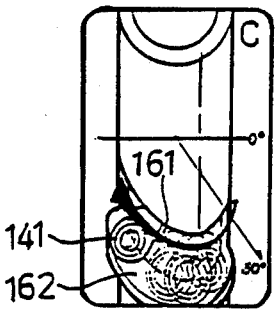
Fig. 9C
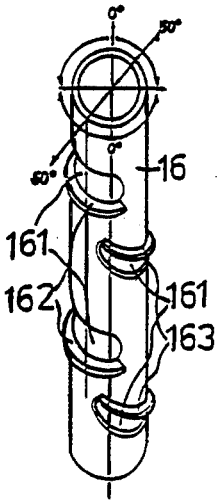
Fig. 8
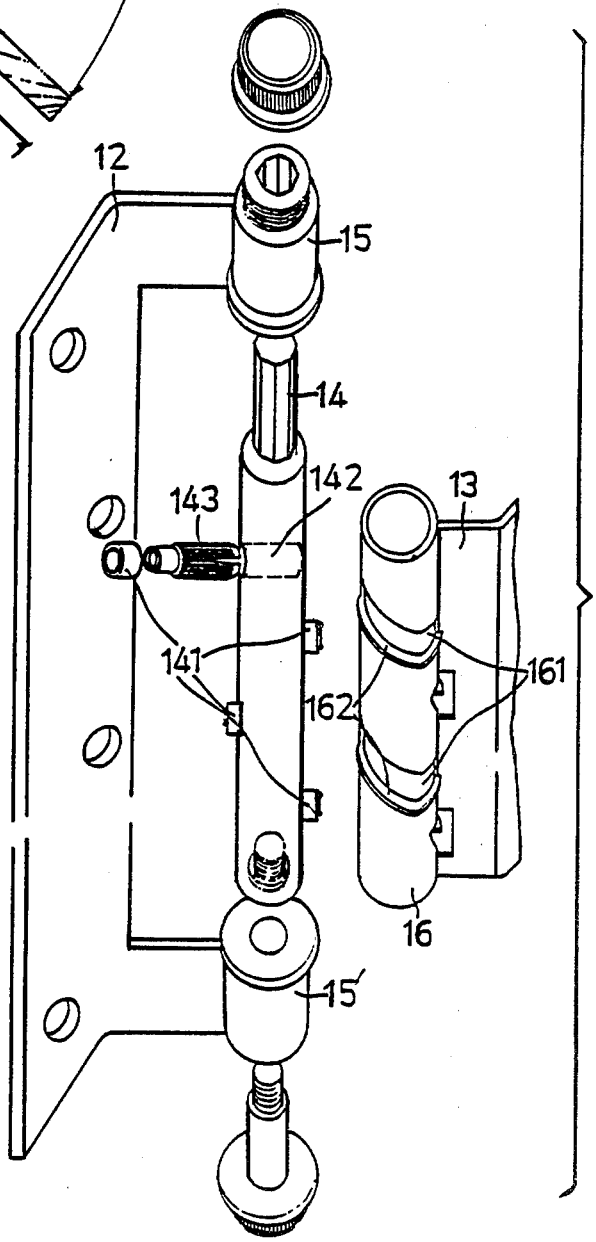
Fig. 6

SELF-CLOSING DOOR HINGE

BACKGROUND OF THE INVENTION

The conventional door hinge is composed of two leaves each engaging with the other by pivot and sleeve. One leaf is fixed on the door edge and the other is fixed on the door frame. It plays the role for pivotting the door when opening or closing the door. For automatically closing the door with conventional hinge, a hydraulic system means may be used for this purpose. Said automatic door closing means of hydraulic system is provided on the upper portion of door and on the horizontal beam of the upper door frame. The hydraulic door closing means will exert a great resisting force so that a big force should be applied to push the door whenever opening the door. Said closing means is provided on the upper portion of the door. The door opening force is unhomogeneous. The door will thus be easily deformed or damaged. Said heavier door system is used for bigger steel door or aluminum door. It is not suitable for general wooden door. Its structure is complicated and not economic for wider applications.

Another automatic door closing means is made of spring which is fixed on the upper portion of door near hinge pivot and the frame. The spring will lose its resilient effect after long time service and will affect the door for incomplete closing. It is also used for small door or window and is not suitable for heavier door.

SUMMARY OF THE INVENTION

The present invention relates to a self-closing door hinge, particularly to a door hinge which will make the door automatically closing after opening the door and releasing the hand.

The object of the present invention is to provide a door hinge having a main hinge and two auxiliary hinges. Said main hinge is composed of: A right hinge leaf with sleeve and a left hinge leaf with pivot.

Said pivot of left leaf is provided with extended pin rollers which engage with the grooves in said sleeve of the right leaf. Said grooves are made horizontally from 0 degree through 50 degrees based on the zero degree line as door closing and then inclined upwards from 50° to 180°. Whenever opening the door, the pivot of the left hinge leaf fixed on the door will be rotated so that the pin rollers thereof may be slipped along the grooves so as to raise the left hinge leaf and door upwards against the right hinge leaf which is fixed on the door frame. The two auxiliary hinges are respectively provided on the upper portion and lower portion of the door and the counter parts on the frame which are used to stabilize the door of the present invention.

The raised door having potential will automatically fall by the gravitational force so as to close the door itself.

BRIEF DESCRIPTION OF THE DRAWINGS

FIG. 1 is the elevation drawing of the self-closing door hinge fixed on door in accordance with a first embodiment of the present invention.

FIG. 2 is the perspective drawing of the door with said self-closing door hinge of the first embodiment in the closing state.

FIG. 3 is the drawing of the door with the first embodiment of the present invention in the open state.

FIG. 4 is the perspective drawing of the sleeve of the right hinge leaf from either face (A,B) thereof in accordance with the first embodiment of the present invention.

FIG. 5 is the top-view drawing of the present door of the first embodiment as closing or opening.

FIG. 6 is the disassembling drawing of the first embodiment of the present invention.

FIG. 7 is the perspective drawing of the pivot of the first embodiment of the present invention.

FIG. 8 is the perspective drawing of the sleeve of right hinge leaf of the first embodiment of the present invention.

FIG. 9 is the assembling and operation drawing of pin rollers within said pivot of the first embodiment of the present invention.

DESCRIPTION OF THE PREFERRED EMBODIMENT

EXAMPLE 1

Figure 10:
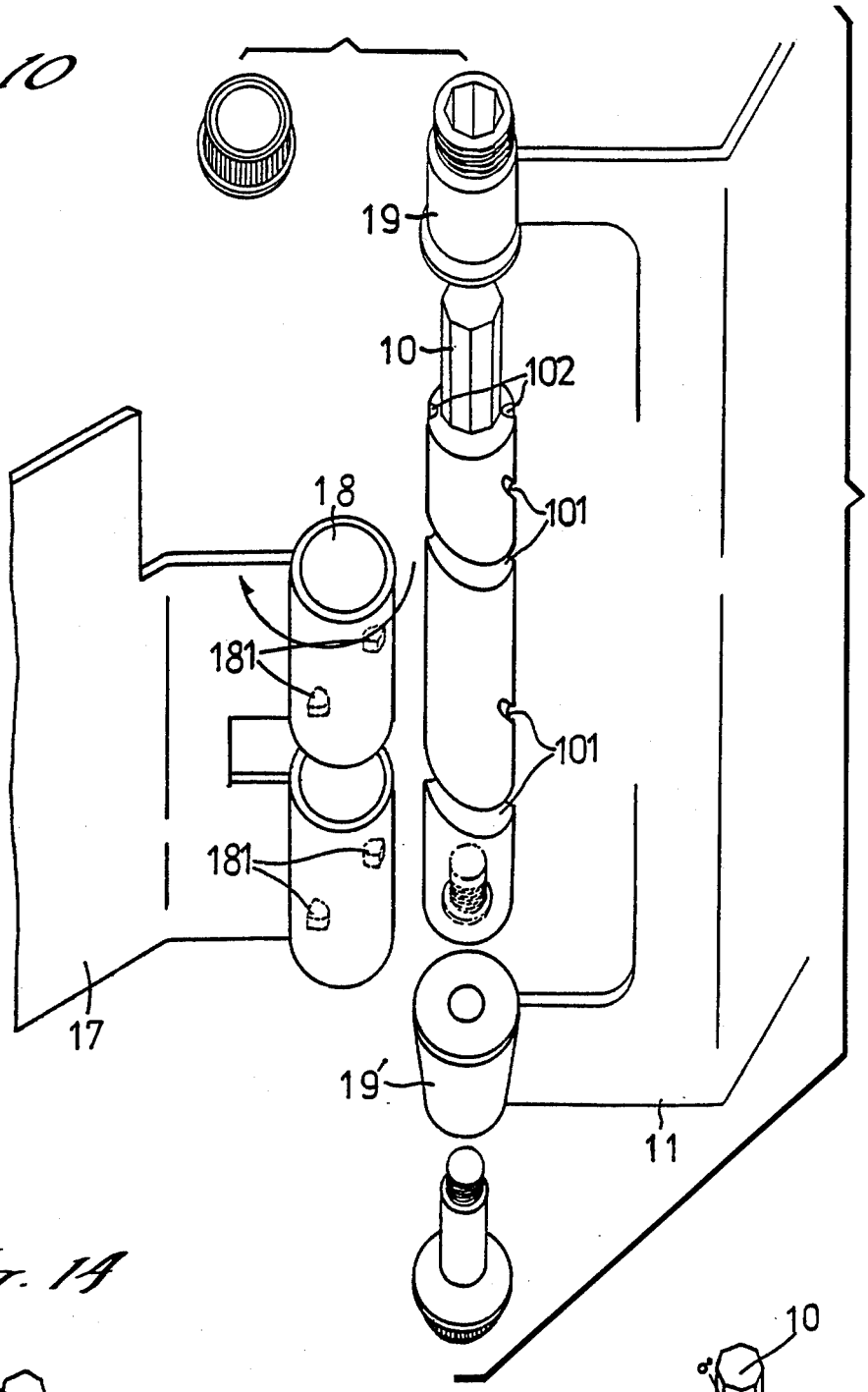
FIG. 10 is the disassembling drawing of a second embodiment of the present invention.

As shown in FIG. 1, the self-closing door hinge of the present invention comprises: A main hinge 1 and two auxiliary hinges 2. Each hinge is composed of two leaves, one is fixed on the door frame 3 and the other fixed on the corresponding edge of the door 4. The main hinge 1 is provided on the middle position of the door and frame. The auxiliary hinges 2 are respectively provided on the upper position and lower position of said door and frame.

The main hinge 1, as shown in FIG. 6, comprises: A left hinge leaf 12, a right hinge leaf 13 and the pivot 14. Each hinge leaf is bent with an angle of 90 degrees. Pivot brackets 15, 15' are respectively provided on the upper end and lower end of said left hinge leaf 12. A sleeve 16 is provided on the middle position of said right hinge leaf 13. The length of said sleeve 16 is short than the distance between said two brackets 15, 15' so as to allow a moving space for upward and downward motion of said pivot 14.

Four inclined grooves 161 are provided on said sleeve 16. The upper end of said pivot 14 is made hexagonally to engage with the hexagonal tunnel in upper bracket 15 of the left hinge leaf 12 for their fixation.

Four pin rollers 141 are provided on said pivot 14. Pin holes 142 are performed on said pivot 14. Then fix the pin 143 into said hole 142 by breaking the front end of said pin 143 and then inserting said pin into said hole 142. Finally fix the pin roller 141 onto said pin 143.

When assembling the hinge 1, the pivot 14 is fixed into the sleeve 16 of said right hinge leaf 13. Then move to the left hinge leaf 12 between two bracket 15, 15' thereof. Insert the upper end of pivot 14 into bracket 15 and lower end into bracket 15'.

Then fix both the upper bracket 15 and lower bracket 15' by nuts. The pin 143 is fixed, through groove 161, into pin hole 142. Then insert the small pin roller 141. The integrated door hinge 1 is shown in FIGS. 2 and 3.

As show in FIG. 4, both sides of said sleeve 16 may be seen. (Front side view, A; Back side view B.) Two grooves A1, A2 are provided on said sleeve from A side (view). Two grooves B1, B2 are provided on B side of said sleeve 16. The width of said groove is slightly larger than the diameter of the pin roller 141 on said pivot 14.

The length of said groove equals to the half perimeter of said sleeve 16, that is, to cover the angular degree from 0 through 180. Two grooves on each side (A and B) are distributed crossingly on said sleeve 16 so that the vertical arrangement is A1, B1, A2, B2, in turn. Every groove is first made horizontally from 0° through 50° based on the zero degree line L as closing door, then inclined upwards from 50° through 180°.

The operating principle may be seen from FIG. 5. Whenever opening the door, the door is first opened from 0° through 50° to release the overlapping of the door with the frame. Then, from 50° through 180°, the door will be rotated and raised as the pivot 14 has been raised along the inclined (upward) groove 161. The raised door will get the potential and will automatically full to close the door itself without any other power source after releasing the hand.

The horizontal length or degree of groove can be adjusted to suit for the practical requirement for diversified sizes and dimensions of doors and frames.

As shown in FIG. 9, A shows the assembling of pin roller 141 onto said pivot 14. From B of FIG. 9, an extension 162 is provided under the groove 161 for A side of sleeve 16 and an extension 163 is provided above the groove 161 of B side of sleeve 16. These extensions are provided to stabilize the motivation of said pin roller 141.

Two auxiliary hinges 2 are respectively provided on the upper and lower position of the door and frame for reinforcing the door.

EXAMPLE 2

Another embodiment of Example 2 is similar to Example 1 except the structure.

As shown in FIG. 10, the right hinge leaf 11 is fixed on the door frame 3. The leaf hinge leaf 17 is fixed on the door 4. The pivot 10 is sturdily fixed onto bracket 19 of the right hinge leaf 11.

Figure 14:
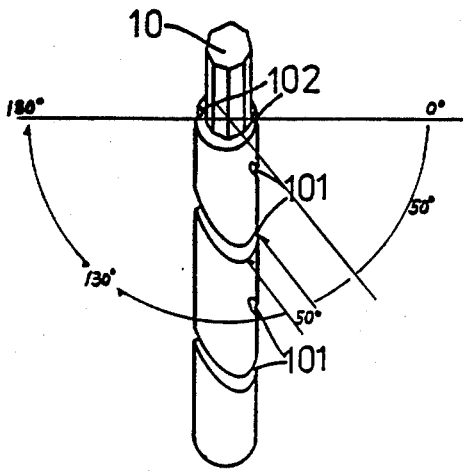
FIG. 14 is the perspective drawing of pivot of the second embodiment of the present invention.

Four inclined grooves 101 are provided on said pivot 10. The groove is made as same as in Example 1. (FIG. 14).

Four lugs 181 are provided in sleeve 18 of said left hinge leaf 17. Their locations are corresponding to four grooves 101 on pivot 10. Whenever opening the door, the lugs 181 in sleeve 18 will be slipped and then raised along the groove 101 of pivot 10. The door will then be opened and raised to get potential which will fall automatically to close the door itself after releasing the hand.

Figure 15:
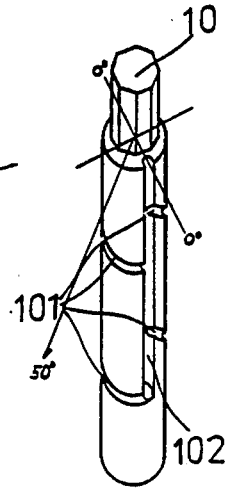
FIG. 15 is the perspective drawing of the second embodiment taken from other side.
Figure 11:
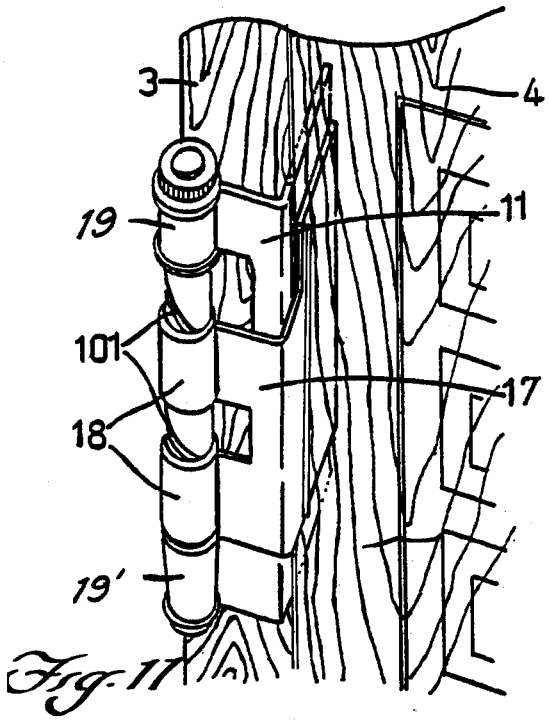
FIG. 11 is the perspective drawing of the second embodiment as closing state.
Figure 12:
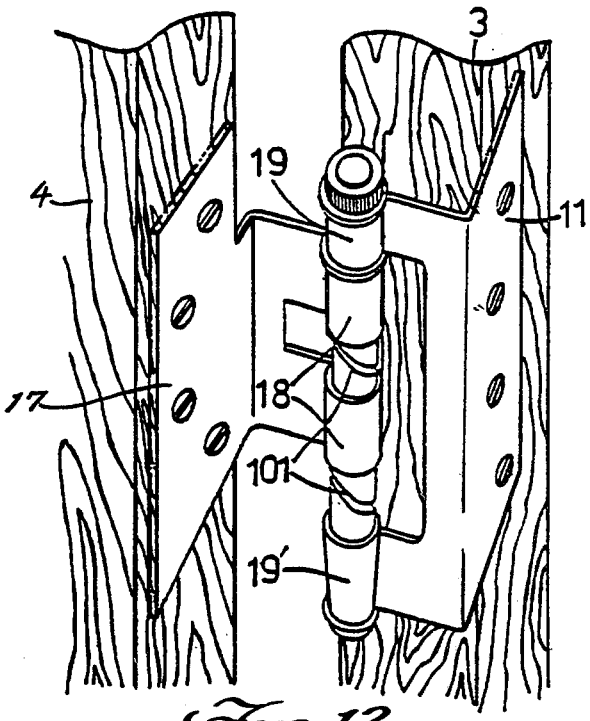
FIG. 12 is the perspective drawing of the second embodiment as opening state.
Figure 13:
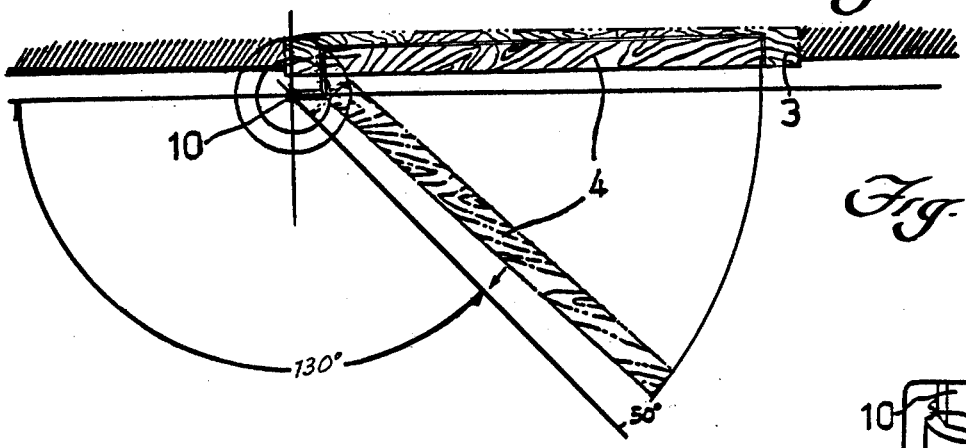
FIG. 13 is the top-view drawing of the second embodiment of the present invention as closing or opening.
Figure 16D:
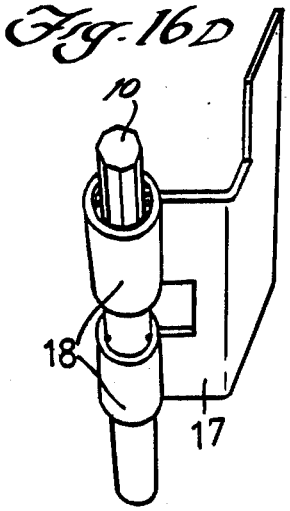
FIG. 16 is the perspective drawing of the operation of the pivot with the right hinge leaf in accordance with the second embodiment of the present invention.
Figure 16A:
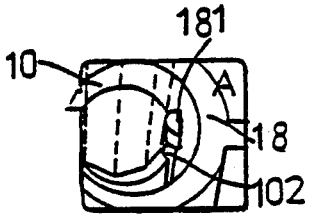
Figure 16C:
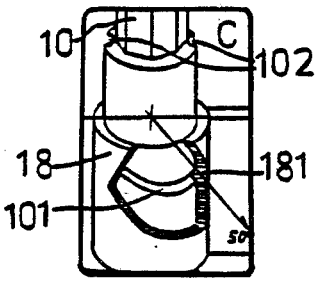
Figure 16B:
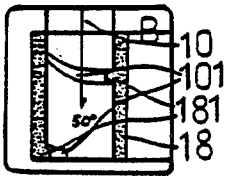

As shown in FIG. 15, a vertical groove 102 on pivot 10 is provided to insert the sleeve 18. The lug 181 will engage with said vertical groove 102 (FIG. 16-A). FIG. 16-B show the engagement drawing of sleeve 18 with pivot 10. FIG. 16-C is their partial sectional drawing.

I claim:

1. A self-closing door hinge arrangement comprising, a main hinge which may be fixed in a middle position of a door and door frame, and two auxiliary hinges respectively fixed on the upper and lower position of said door and frame; said main hinge including a right hinge leaf with sleeve having a plurality of grooves, said grooves having an inclined portion and a horizontal portion and left hinge leaf with pivot, said pivot removably fixedly mounted to said left hinge leaf; said pivot pivotably and vertically movable in said sleeve, and being axially disposed in said sleeve; having a plurality of extended pin rollers each engaging a corresponding one of the grooves on said sleeve; and vertically supporting said pivot and said door such that the pivot and door are raised as each of said pins moves upward along the incline of said groove of said sleeve as said door is opened; and rollers moving identically in said corresponding grooves, said pivot and door falling automatically along the groove to close the door when each of said rollers are in said inclined portion of said grooves and said door is released.

2. A door hinge according to claim 1, in that the grooves of said sleeve each extend halfway around the sleeve, the grooves being made first horizontally from 0 through 50 degrees and then inclined upwards from 50 through 180 degrees.

3. A door hinge according to claim 1 in that, the number of grooves being made even, half of said grooves being formed on one side of said sleeve and another half being formed on the opposite side of said sleeve; said grooves being arranged so that said one side and said opposite side grooves alternate vertically, said sleeve having outward extending lips under each one side groove, and having outward extending lips over each opposite and side groove, for engaging said rollers so as to provide vertical stability to said door when it is turning.

4. A door hinge according to claim 1, the number and position of said pin roller being equivalent and corresponding to that of said grooves in said sleeve of said right hinge leaf.

5. A door hinge arrangement as in claim 1 or claim 3, wherein said pivot includes multiple side faces at one end and a threaded hole at the other end;

said left hinge leaf having an upper bracket with a multiple faced tunnel for non-rotatably receiving said pivot multiple faced end and a lower bracket including screw means for vertically fixing said pivot threaded end;

said pivot having radially disposed holes therein, and said pin rollers having axles removably mounted at one end in said holes and removably mounted to said axles at the other ends of said axles.

6. A door hinge according to claim 2 in that, the number of grooves being formed on one side of said sleeve and another half being formed on the opposite side of said sleeve; said grooves being arranged so that said one side and said opposite side grooves alternate vertically, said sleeve having outward extending lips under each one side groove and having outward extending lips over each opposite side groove for engaging said rollers so as to provide vertical stability to said door when it is turning.

* * * * *